US009784257B1

(12) United States Patent
Liu

(10) Patent No.: US 9,784,257 B1
(45) Date of Patent: Oct. 10, 2017

(54) DEVICE, METHOD AND SYSTEM FOR CHANGING FLEXIBILITY OF A SHEET STRUCTURE

(71) Applicant: X Development LLC, Mountain View, CA (US)

(72) Inventor: Eric H. C. Liu, Redwood City, CA (US)

(73) Assignee: X Development LLC, Mountain View, CA (US)

( * ) Notice: Subject to any disclaimer, the term of this patent is extended or adjusted under 35 U.S.C. 154(b) by 162 days.

(21) Appl. No.: 14/741,110

(22) Filed: Jun. 16, 2015

(51) Int. Cl.

| | |
|---|---|
| ***F04B 9/107*** | (2006.01) |
| ***A41D 13/015*** | (2006.01) |
| ***A41D 13/05*** | (2006.01) |
| ***A41D 27/06*** | (2006.01) |

(52) U.S. Cl.
CPC ..... *F04B 9/107* (2013.01); *A41D 13/05* (2013.01); *A41D 27/06* (2013.01)

(58) Field of Classification Search
CPC ..... F04B 9/107; A41D 13/015; A41D 13/05; A41D 27/06; A41D 1/00; A41D 13/00; A41D 13/002; A41D 13/0025
USPC ..... 251/61, 61.1, 61.2
See application file for complete search history.

(56) References Cited

U.S. PATENT DOCUMENTS

| | | | | |
|---|---|---|---|---|
| 4,741,673 | A | 5/1988 | Jubb | |
| 8,485,041 | B2 | 7/2013 | Ahles et al. | |
| 2004/0161308 | A1 | 8/2004 | Cartwright | |
| 2009/0008582 | A1* | 1/2009 | Reuhs | B65D 81/2038 251/61.1 |
| 2010/0199982 | A1 | 8/2010 | Hansen | |
| 2011/0254789 | A1 | 10/2011 | Ciesla et al. | |
| 2014/0173812 | A1* | 6/2014 | Krueger | A42B 3/122 2/455 |

* cited by examiner

*Primary Examiner* — Kevin Lee
(74) *Attorney, Agent, or Firm* — Christensen O'Connor Johnson Kindness PLLC

(57) ABSTRACT

Techniques and mechanisms for changing a flexibility of a sheet structure. In an embodiment, a garment or other device includes sheet structure, where an interface region is disposed between overlapping layer portions of a sheet structure. While a pressure differential is maintained between the interface region and a chamber of the garment, a valve of the garment is opened to allow an exchange of fluid between the interface region and the chamber. In another embodiment, the exchange of fluid changes a flexibility of the sheet structure by initiating or alleviating friction jamming between the overlapping layer portions.

20 Claims, 10 Drawing Sheets

DEVICE, METHOD AND SYSTEM FOR CHANGING FLEXIBILITY OF A SHEET STRUCTURE

BACKGROUND

1. Technical Field

This disclosure relates generally to safety equipment and more particularly, but not exclusively, to controlling the flexibility of a human-wearable garment.

2. Background Art

Sports, outdoor recreation, workplace safety, healthcare and eldercare are just some areas of human activity which are concerned with instances of sudden and/or excessive forces resulting in injury to a person. Significant amounts of money are spent in these areas for safety equipment to limit the possibility, or at least the extent, of such injury. Often, extensive training is also needed in the use of such equipment, which can be expensive both in terms of money and lost productivity. Moreover, safety equipment can be cumbersome, affecting the ability of people—whether workers, players, patients or the like—to perform various actions.

As the average ages of some populations around the world increase, the use of personal safety devices is expected to grow. This is at least one reason for an increasing need to provide affordable, effective safety equipment that allows for everyday activity of a wearer and/or that can provide for injury protection without requiring extensive training.

BRIEF DESCRIPTION OF THE DRAWINGS

The various embodiments of the present invention are illustrated by way of example, and not by way of limitation, in the figures of the accompanying drawings and in which.

DETAILED DESCRIPTION

Figure 1:
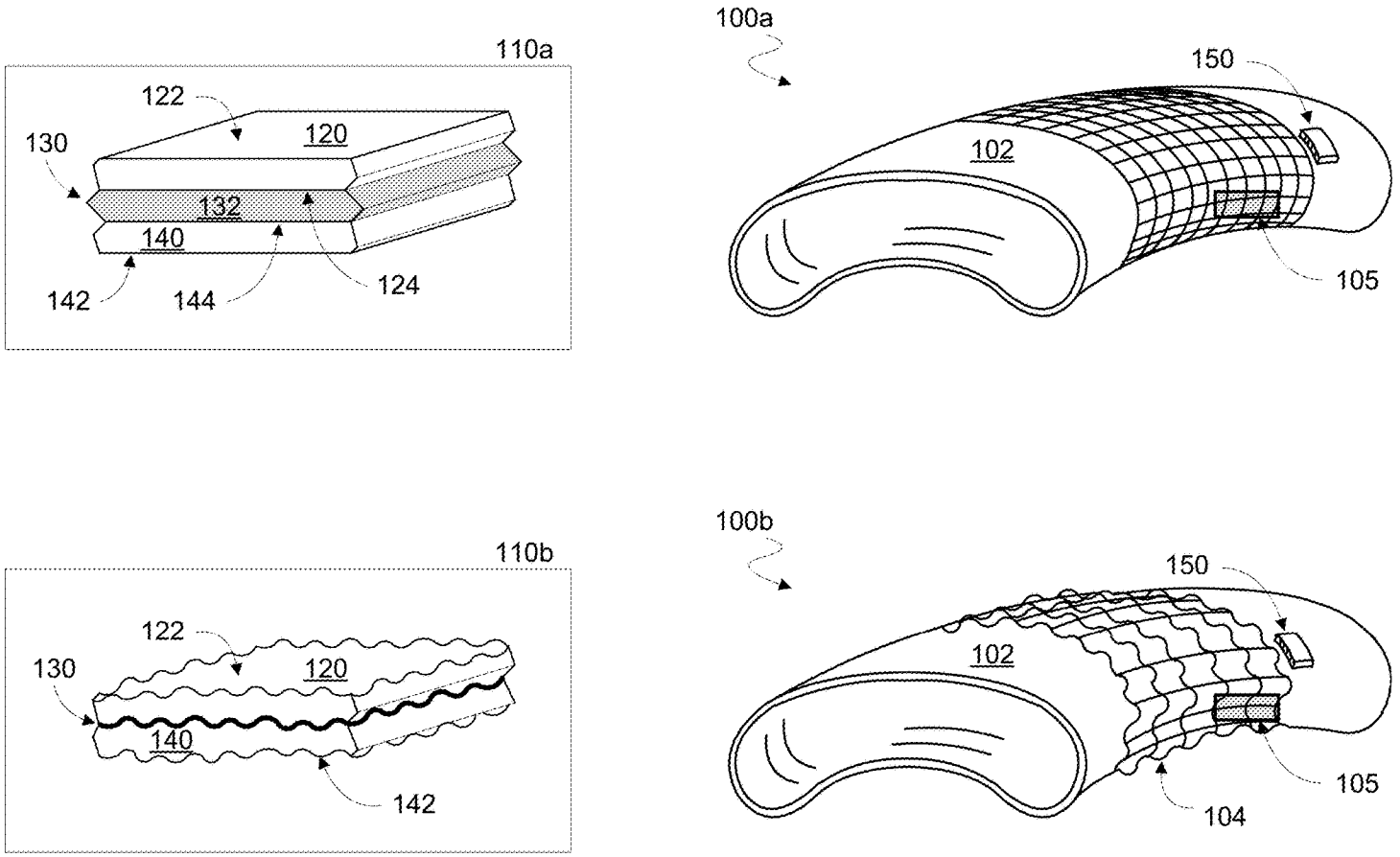
FIG. 1 shows perspective views of a device operable to change flexibility according to an embodiment.

Embodiments of an apparatus, system and methods of changing a flexibility of a sheet structure are described herein. In the following description numerous specific details are set forth to provide a thorough understanding of the embodiments. One skilled in the relevant art will recognize, however, that the techniques described herein may be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Embodiments discussed herein variously relate to techniques and/or mechanisms for transitioning at least part of a sheet structure, such as a portion of a garment, between a relatively more flexible state and a relatively less flexible state. For example, a sheet-like portion of a garment may include overlapping portions of layered material, where the garment comprises a mechanism to change a flexibility of a region that includes such portions of layered material. For brevity, a portion of layered material of such a sheet structure is referred to herein as a "layer portion," and a mechanism to change such flexibility is referred to herein as an "actuator." Accordingly, "actuation" and "actuating"—as well as "activation" and "activating"—are variously used herein to refer to the transitioning of a sheet structure between states comprising different respective levels of flexibility.

A relatively rigid or inflexible state of a sheet structure (as compared to another, more flexible state that sheet structure) may be implemented by what is referred to herein as "friction jamming," wherein overlapping layer portions of a sheet structure are pressurized against one another by a pressure of a surrounding environment. For example, a region internal to the sheet structure—e.g., a region between overlapping layer portions—may allow for a small volume of a fluid (such as air, oxygen, water or the like) to be disposed therein. When a pressure level of such a fluid is relatively close to an ambient pressure of an environment surrounding the sheet structure, that ambient pressure is more likely to allow for bending of the sheet structure. However, when the pressure level of such a fluid is decreased—e.g., by decreasing the volume of the fluid in the internal region—the ambient pressure of the surrounding environment is more likely bring internal surfaces within the sheet structure into pressurized contact with one another. As a result, overlapping layer portions of the sheet structure are more likely to exhibit deformation and/or increased friction between one another, which in turn results in increased resistance to forces that would otherwise bend the sheet portion.

Implementing (or alternatively, alleviating) friction jamming according to some embodiments includes operating a valve mechanism of an actuator to decrease a pressure differential previously built up between a chamber and a region—for brevity, referred to herein as an "interface region"—between overlapping layer portions of a sheet structure. Such friction jamming may be relatively long-term (e.g., when an interface region is formed with an impermeable material) or short-term (e.g., where at least one layer portion comprises a permeable textile that allows for fluid to return to an interface region from a surrounding environment).

Features of various embodiments are described herein with reference to a garment that may be worn by a person. However, such description may be extended to additionally or alternatively apply to any of a variety of other devices, at least a portion of which comprises a sheet structure and actuator mechanisms set forth herein. In an embodiment, an actuator of a garment (or other device comprising such a sheet structure) includes or couples to a chamber that is to maintain a pressure level different than a level of pressure in an interface region between layer portions of the garment. The actuator may comprise a valve mechanism and control logic (e.g., including hardware, firmware and/or executing software) including circuitry to operate the valve mechanism. One or more tubes and/or plumbing hardware may variously couple the valve mechanism between the chamber and the interface region. Such one or more tubes may be comprised of metal, plastic, rubber or other materials, and may be rigid, semi-rigid or flexible, according to various embodiments.

The control logic may comprise integrated circuitry—e.g., of an application-specific integrated circuit, a field-programmable gate array (FPGA), a microcontroller, processor logic (such as a microprocessor, central processing unit, etc.) or the like—that is disposed on an exterior surface of the device or, alternatively, is internal to the device. Responsive to the control logic, the valve mechanism may be configured to allow a path of fluid exchange for rapidly equalizing or otherwise decreasing the pressure differential that was previously built up between the chamber and the interface region. In an embodiment, the control logic signals a valve to open based on an indication that a detector (e.g., included in or, alternatively, in communication with the control logic) has detected an instance of some pre-defined activation condition. Although certain embodiments are not limited in this regard, the detector may be a device that is separate from the garment (or other device including a sheet structure)—e.g., wherein the detector communicates wirelessly with the control logic.

An activation condition sensed by the detector may include or otherwise indicate one or more conditions of the garment, of the wearer of the environment and/or of a surrounding environment of the garment and wearer. By way of illustration and not limitation, the garment may comprise one or more accelerometers, stress sensors, pressure sensors or the like to detect a force being imposed on the garment. In such an embodiment, an activation condition may include a magnitude, rate of change, frequency, direction or other characteristic of such a force. Alternatively or in addition, the garment might include, or be in communication with, one or more biometric sensors. In such an embodiment, an activation condition may include a heart rate, temperature, amount of perspiration, brain wave activity or other characteristic of a wearer of the garment. An activation condition may additionally or alternatively include any of a variety of one or more environmental or other extrinsic conditions—e.g., a geographic location of the garment, collision of an automobile in which the garment and wearer are located, and/or the like. In some embodiments, an activation condition sensed by the detector includes an explicit command to activate the garment. Such an explicit command may be provided, for example, based on a person—e.g., from a wearer of a garment or, alternatively, some health care worker or other attendant responsible for the wearer of the garment—interacting with a user interface mechanism (e.g., a button, microphone, touchpad, mouse, etc.) included in or coupled to the detector. In another embodiment, an activation condition includes an absence of a signal—e.g., a proximity indication signal—the presence of which is otherwise to prevent activation of the sheet structure. Sensing of such activation condition may include operations adapted from conventional sensing method and/or techniques, which are not detailed herein to avoid obscuring various embodiments. Some embodiments are not limited to a particular type of activation condition, a particular mechanism for detecting such an activation condition or a particular mechanism for signaling detection of an activation condition to the garment.

FIG. 1 illustrates elements of a garment 102 that may be activated to change flexibility according to an embodiment. Garment 102 may include a single sheet structure or multiple sheet-like portions that have been stitched, glued or otherwise joined with one another directly or indirectly. In an embodiment, garment 102 includes a shirt, pair of pants, sock, glove, hood, sleeve or other such product that may be pulled around at least part of a user's body. Alternatively, garment 102 may include a scarf, wrap, blanket or other sheet structure capable of being wrapped around at least part of a user's body.

Cross-sectional detail view 110*a* shows features of a sheet structure 105 of garment 102 during a state 100*a* when sheet structure 105 is relatively flexible. By contrast, cross-sectional detail view 110*b* shows features of sheet structure 105 during a state 100*b* when sheet structure 105 is relatively inflexible (stiff), as compared to during state 100*a*. As shown in cross-sectional detail view 110*a*, sheet structure 105 may include a layer portion 120 forming an exterior surface 122 and another layer portion 140 forming another exterior surface 142. Features of layer portion 120 and/or layer portion 140 (e.g., thickness, material, weaving, thread size, etc.) may be chosen to achieve particular characteristics of sheet structure 105. Such characteristics may include, for example, flexibility, friction with the same or a different type of layer portion, impermeability, durability, mechanical strength, resistance (e.g., to impacts, tearing, etc.), resistance to environmental conditions (temperature, moisture, gasoline, solvents and/or the like), easy of fabrication and/or the like. In one embodiment, one or each of layer portions 120, 140 has a thickness between 0.01" and 0.2"—e.g., where sheet structure 105 has a total thickness of 0.5" or less. However, such dimensions are merely illustrative, and may vary according to implementation-specific details.

One or each of layer portions 120, 140 may include any of a variety of textiles and/or other flexible materials. For example, a layer portion of garment 102 may include one or more of a rubber, latex, plastic or other impermeable film material. A textile of a layer portion may include woven or otherwise processed natural fibers comprising cotton, wool, hemp and/or the like. Alternatively or in addition, the textile may include polyester, acrylic, nylon, rayon, Gore-tex®, carbon fiber and/or any of other various synthetic fibers. In some embodiments, one or each of layer portions 120, 140 includes multiple respective constituent layered portions of different materials (not shown). Certain embodiments are not limited with respect to a particular material of layer portion 120 and/or layer portion 140.

An interface region 130 may include, or be formed by, at least some region where respective interior surfaces 124, 144 of layers 120, 140 face one another but are not adhered or otherwise joined to one another. Some or all sides of interface region 130 may be formed by locations (not shown) where layer portions 120, 140 are joined to one another. For example, respective regions of layer portions 120, 140 may be stitched, glued, melted, laminated or otherwise joined with one another to form a perimeter of interface region 130. In another embodiment, regions of a single, contiguous layer of material may be cut or otherwise split from one another to form layer portions 120, 140 and at least a side of interface region 130. In some embodiments, a bladder, balloon, pouch, sack, vesicle, etc. or other flexible enclosure (also referred to herein as a "cell") is disposed between exterior surfaces 122, 142. For example, one part of such a flexible enclosure may be glued or otherwise joined with other material of layer 120 to form interior surface 124, where another part of the same flexible enclosure is glued or otherwise joined with other material of layer 140 to form interior surface 144. In some embodiments, one or more sidewalls of interface region 130 are formed by a contiguous boundary material (not shown) that extends from interior surface 124 to interior surface 144.

At different times, interface region 130 may contain a fluid 132 (e.g., including a gas such as air, or a liquid such as water) at different levels of pressure. For example, garment 102 may have disposed therein or thereon an actuator 150 coupled to change a pressure in interface region 130. As discussed herein, actuator 150 may include or couple to a chamber (not shown), where a pre-configured pressure differential between interface region 130 and such a chamber allows for quick transition between states 100*a*, 100*b*. In response to a trigger event (e.g., including detection of an instance of a pre-defined actuation condition), actuator 150 may open a path that allows for fluid flow between the chamber and interface region 130, resulting in a quick change in a flexibility of at least sheet structure 105 of garment 102.

The pressure of fluid 132 may be different between states 100*a*, 100*b* and, in at least one such state, may differ from an ambient pressure of an environment in which garment 102 is located. In the illustrative embodiment shown, state 100*a* includes fluid 132 having a pressure that is greater than the pressure of fluid 132 during state 100*b*. By way of illustration and not limitation, the pressure of fluid 132 during state 100*a* may be substantially equal to the ambient pressure outside of garment 102, where the pressure of fluid 132 during state 100*b* is less than 70% (e.g., less than 50%) of that ambient pressure. However, fluid 132 may have any of a variety of alternative pressures in one or each of states 100*a*, 100*b*, according to implementation-specific details. As used herein with reference to pressure levels, "substantially equal to" refers to a pressure being within ±10% of another pressure.

Although detail view 100*a* shows interior sides 124, 144 as being separated from one another by fluid 132, certain embodiments are not limited in this regard. For example, the volume of fluid 132 during state 100*a* may be small enough to allow at least some regions of interior sides 124, 144 to be in direct contact with one another at times. However, the pressure of fluid 132 during state 100*a* may provide resistance to the ambient pressure of the environment sufficient to allow such regions to slide across one another and/or bend with one another. By contrast, the pressure of fluid 132 during state 100*b* may allow the ambient pressure of the environment to press layer portions 120, 140 together with enough force for pressurized contact between interior sides 124, 144. As a result, increased friction between interior sides 124, 144 may resist relative motion between interior sides 124, 144—e.g., even on a microscopic scale. In some embodiments, such pressurization of layer portions 120, 140 together during state 100*b* may result in microscopic and/or macroscopic folding, wrinkling and/or other distorting of layer portions 120, 140—as represented by the illustrative deformations 104. Deformations 104 may additionally or alternatively provide for mechanical resistance to flexibility of layer portions 120, 140 during state 100*b*.

Figure 2:
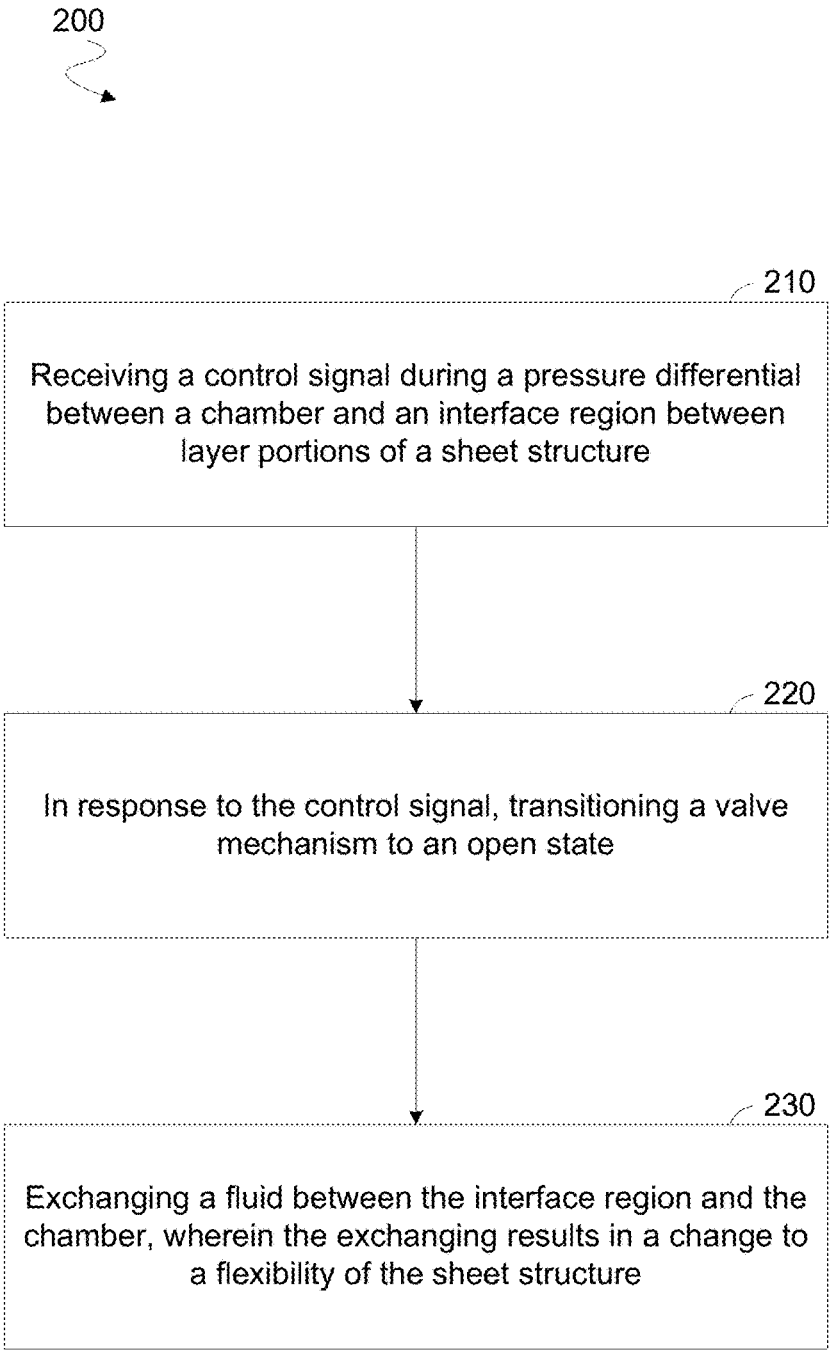
FIG. 2 is a flow diagram illustrating elements of a method for changing a flexibility of a sheet structure according to an embodiment.

FIG. 2 illustrates elements of a method 200 for changing a flexibility of a sheet structure according to an embodiment. Method 200 may be performed to change flexibility of at least part of a garment having some or all of the features of garment 105. For example, one or more operations of method 200 may be performed with actuator 150.

Figure 3:
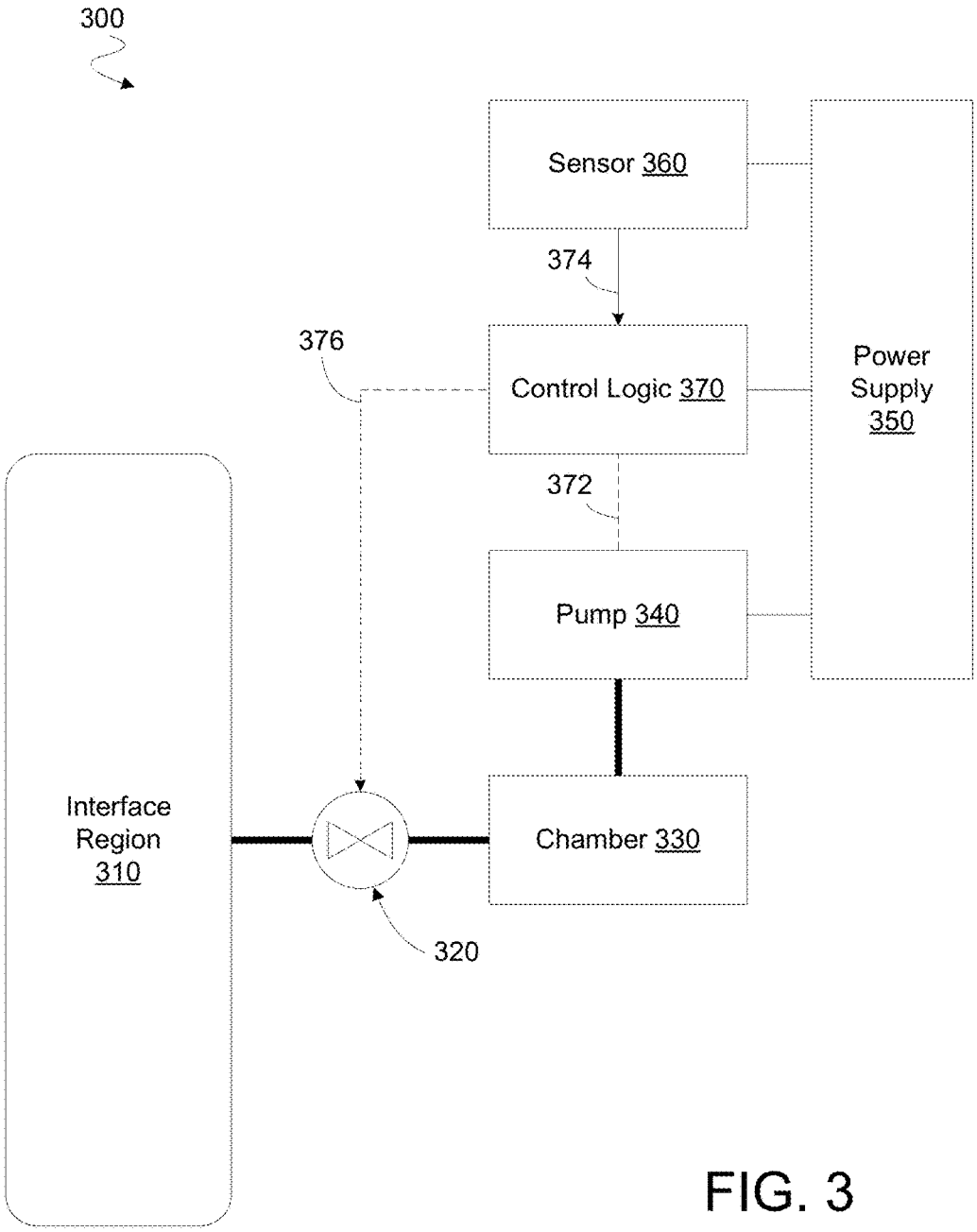
FIG. 3 is a functional block diagram illustrating elements of a device to change flexibility of a sheet structure according to an embodiment.

To illustrate certain features of various embodiments, method 200 is described herein with reference to an illustrative garment 300 shown in FIG. 3. However, such description may be extended to additionally or alternatively apply to any of a variety of other devices including a sheet structure and an actuator mechanism, according to an embodiment, to change a flexibility of such a sheet structure. Garment 300 includes an interface region 310—e.g., interface region 130—formed between respective opposing interior surfaces of layer portions (not shown) that form at least part of a sheet structure.

An actuator of garment 300 may include a chamber 330 and a valve mechanism, as represented by the illustrative valve 320, coupled between chamber 330 and interface region 310. Chamber 330 may include a canister, tank or other such pressure vessel that, at a given time, may be selectively pressurized (with air or another fluid) or depressurized. Chamber 330 may comprise aluminum, carbon fiber, resin and/or any of a variety of composite, metal or other materials—e.g., adapted from conventional pressure vessel fabrication techniques. In an embodiment, a capacity of chamber 330 is small enough (e.g., in a range from 2 $cm^3$ to 20 $cm^3$) for garment 300 to be comfortably worn by a user. However, certain embodiments are not limited to a particular size, shape or material of chamber 330. Valve 320 may operate to selectively close or open a path of fluid exchange between interface region 310 and chamber 330. In one embodiment, valve 320 includes a three-way valve that, for example, may be further operable to open another path of fluid exchange between interface region 310 and an ambient environment in which garment 300 is located.

A pump 340 included in (or in an alternate embodiment, coupled to) garment 300 may be operated in combination with valve 320 to provide for a pressure differential between chamber 330 and interface region 310. For example, prior to or during method 200, garment 300 may be configured to prepare for a quick change in the flexibility of at least part of garment 300. In one illustrative embodiment, circuitry of control logic 370 disposed under or on an exterior surface of garment 300 may send a control signal 376 to close valve 320 and a control signal 372 to transition a pressure of chamber 330 away from a current pressure of interface region 310. A power supply 350—e.g., comprising a battery, a solar cell, etc.—may power operation of control logic 370, pump 340 and/or other actuator components of garment 300. In one illustrative scenario according to an embodiment, interface region 130 is, during some preliminary point in time, at a pressure that allows for flexibility of garment 300 at least in a portion including interface region 130. During this time, pump 340 may operate to at least partially evacuate chamber 330 to a lower pressure. However, it will be appreciated to those of skill in the art that in another scenario, interface region 130 may alternatively be in a low pressure, relatively inflexible state, where pump 340 operates to pressurize chamber 330.

Method 200 may include, at 210, receiving a control signal during such a pressure differential between a chamber and an interface region between layer portions of a sheet structure. For example, garment 300 may include (or in another embodiment, be communicatively coupled to) a sensor mechanism—as represented by the illustrative sensor 360—that detects for an event indicating a need to trigger a change in a flexibility of garment 300. For brevity, such an event is referred to herein as a "trigger event." In an illustrative scenario according to one embodiment, the receiving at 210 may include control logic 370 receiving from sensor 360 an indication 360 that garment 300 needs to become relatively more rigid (or alternatively, relatively less rigid).

In response to the control signal, method 200 may, at 220, transition a valve mechanism to an open state. For example, the transitioning at 220 may include valve 320 opening a path of fluid flow between interface region 310 and chamber 320. Method 200 may further comprise, at 230, exchanging a fluid between the interface region and the chamber, wherein the exchanging results in a change to a flexibility of the sheet structure. For example, during the open state of valve 320 (or alternatively, prior to the open state), the layer portions that form interface region 310 may be pressurized against one another. In an embodiment, the exchanging at 230 may result in friction jamming being initiated (or alternatively, stopped or otherwise alleviated) between such layer portions—e.g., in response to at least partial evacuation of the interface region 310.

Figure 4:
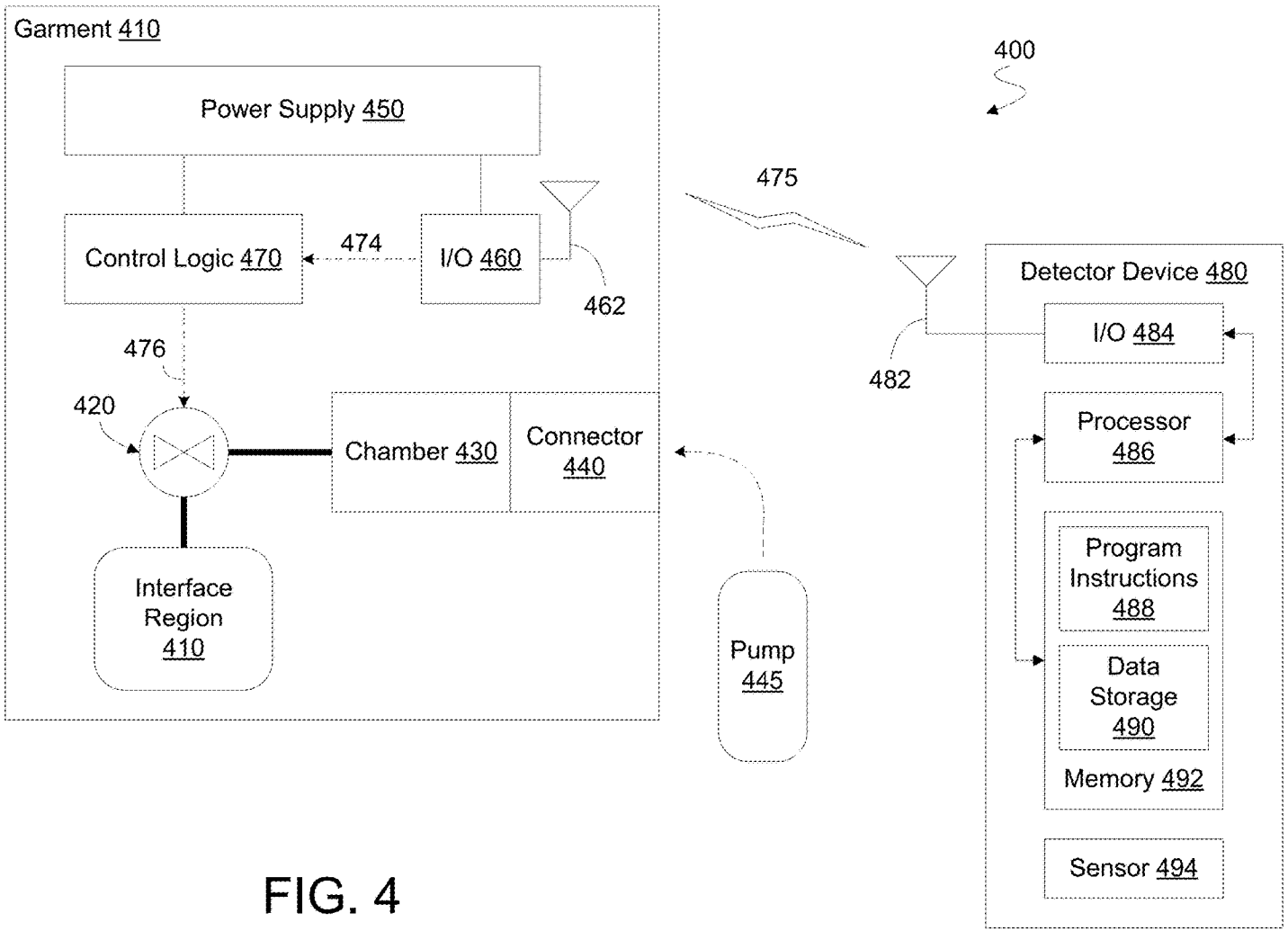
FIG. 4 is a functional block diagram illustrating elements of a system to change flexibility of a sheet structure according to an embodiment.

FIG. 4 illustrates elements of a system 400 to change a flexibility of a sheet structure according to another embodiment. System 400 includes a garment 410 and a detector device 480 that is in wireless communication with garment 400. Garment 410 may include some or all of the features of garment 100, for example.

Garment 400 includes an interface region 410—e.g., including interface region 130—formed between respective opposing interior surfaces of layer portions (not shown) that form at least part of a sheet structure. An actuator of garment 400 may include a chamber 430 and a valve mechanism, as represented by the illustrative valve 420, coupled between chamber 430 and interface region 410. Chamber 430 may include a canister, tank or other such pressure vessel that, at a given time, may be selectively pressurized (with air or another fluid) or depressurized. Valve 420 may include a ball valve, gate valve or other such device coupled to selectively close or open a path of fluid exchange between interface region 410 and chamber 430. A pump 445 may be initially coupled to (and subsequently decoupled from) garment 400 via a connector 440. While coupled, pump 445 may change a pressure of chamber 430 to provide a pressure differential relative to a pressure of interface region 410—e.g., while valve 420 is in a closed state. While such a pressure differential is maintained with valve 420, garment 410 is configured for a subsequent activation to change a flexibility of at least a portion including interface region 410. In an illustrative scenario according to one embodiment, such activation may be triggered in response to a remote device, as represented by the illustrative detector device 480.

The illustrated embodiment of detector device 480 is one example of a device including a sensor 494 to detect a condition of garment 410, a person wearing garment 410, an environment including garment 410 and/or the like. Such a device may also include communication logic, such as the illustrative input and/or output interface I/O 484, to send a signal in response to a condition sensed by sensor 494, the signal indicating that garment 410 is to be activated. In some embodiments, detector device 480 may further include, for example, a processor 486, an antenna 482, and memory 492. The illustrated embodiment of memory 492 includes data storage 490 and program instructions 488. Antenna 482 (or group of more than one antennae) may send and/or receive wireless signals 475 to and from garment 410. Detector device 480 may also include a computing system with a processor 486 in communication with a memory 492. Memory 492 may be a non-transitory computer-readable medium that may include, without limitation, magnetic disks, optical disks, organic memory, and/or any other volatile (e.g. RAM) or non-volatile (e.g. ROM) storage system readable by the processor 486. Memory 492 may include a data storage 490 to store indications of data, such as sensor information (e.g., sensor logs), program settings (e.g., to adjust behavior of garment 410 and/or detector device 480), etc. Memory 492 may also include program instructions 488 for execution by processor 486 to cause the detector device 480 to perform processes specified by the instructions 488. For example, program instructions 488 may cause detector device 480 to signal garment 410 to perform some or all operations of method 200. Detector device 480 may also include one or more hardware components—e.g., of I/O 484—for operating antenna 482 to send and receive wireless signals 475 to and/or from garment 410. Detector device 480 may be a smart phone, digital assistant, or other portable computing device with wireless connectivity sufficient to provide the wireless communication link 475. In some instances, detector device 480 is a special-purpose device configured to be worn by the wearer of garment 410 or, alternatively, by another person. In some embodiments, detector device 480 is a desktop computer, wall-mounted console or other relatively non-portable device.

In one embodiment, circuitry of control logic 470 (e.g., disposed under or on an exterior surface of garment 400) may receive an indication 474 from I/O 460 of garment 410 in response to wireless signals 475 received via one or more antenna 462. In response to indication 474, control logic 470 may determine that a trigger event has taken place and, in response, send a control signal 476 to transition valve 420 to an open state. Opening of valve 420 may result in a sudden exchange of fluid (e.g., air) between interface region 410 and chamber 430. As a result, a portion of garment 410 that defines or is otherwise proximate to interface region 410 may experience an onset of friction jamming (or alternatively, a relief from friction jamming).

Figure 5:
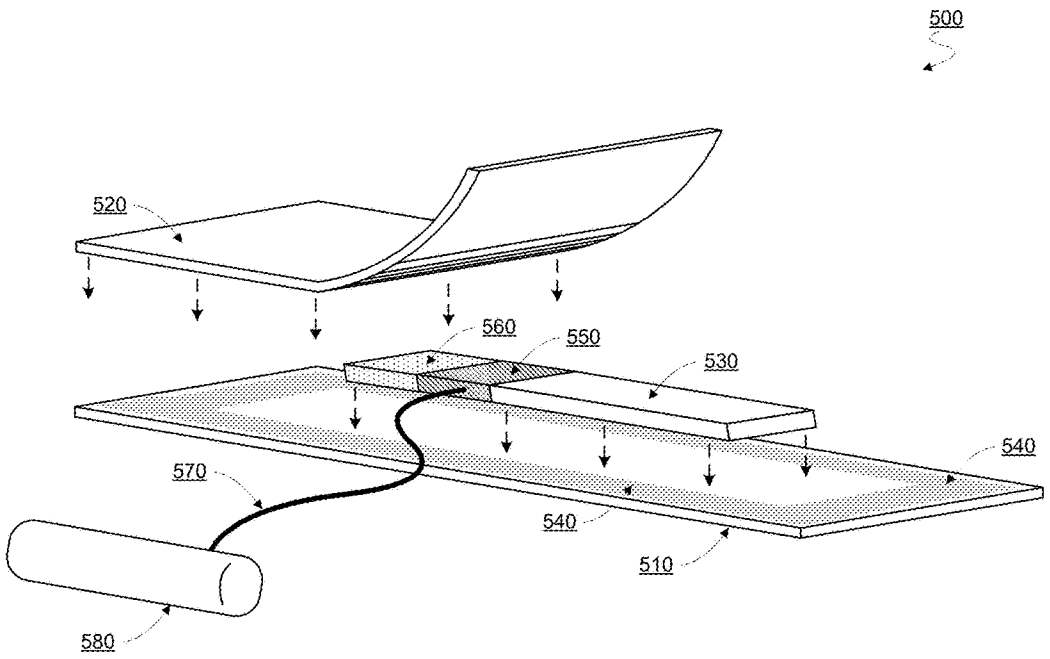
FIG. 5 illustrates features of processing to fabricate a sheet structure according to an embodiment.

FIG. 5 illustrates processing 500, according to an embodiment, to fabricate a sheet structure and an activation mechanism (included or coupled thereto) to change a flexibility of the sheet structure. In an embodiment, the processing 500 forms at least a portion of a garment such as one of garments 100, 300, 410. Subsequent activation of such a garment may include some or all operations of method 200, for example.

In the illustrative embodiment shown, processing 500 includes joining portions of layers 510, 520 which—for example—correspond functionally to layer portions 120, 140. During processing 500, a region 530 (e.g., of interface region 130) may be disposed or otherwise formed between layers 510, 520 to allow for fluid to be variously contained between interior surfaces of layers 510, 520. In an embodiment, layers 510, 520 define some or all of the sides of region 530 (where region 530 is merely some interface between respective areas of layers 510, 520 that can adjoin, but are not adhered to, one another). Although certain embodiments are not limited in this regard, region 530 may be formed by an impermeable, flexible enclosure—e.g., a rubber bladder—disposed between layers 510, 520. For example, a top portion of the enclosure may be adhered to bottom side of layer 520 and a bottom portion of the enclosure may be adhered to a top side of layer 510. In an embodiment, areas 540 of layer 510 may be subjected to processing which is different from processing of the areas that are to adjoin region 530. For example, only areas 540 may be selectively exposed to heat, pressure, radiation (e.g. with UV light) and/or other curing processing to adhere areas 540 to respective opposite areas of layer 520.

Certain embodiments provide for efficient activation mechanisms by enabling the generation of a large pressure differential in advance of an indication that flexibility of the sheet structure is to be changed. For example, a pressure vessel 580 may be coupled to region 530 via a connection 570 (e.g. a pipe or hose) and a valve mechanism 550. Prior to a transition to (or from) a friction jamming state, pressure vessel 580 may have a level of pressure different than that of compartment 530. Valve mechanism 550 may subsequently receive from a sensor 560 a signal indicating that a state transition is to take place. The particular conditions which might cause sensor 560 to generate such a signal vary widely, depending on application-specific details. In response to such a signal, valve mechanism 550 may switch from a closed state to an open state to suddenly change the previously-accumulated pressure differential between pressure vessel 580 and region 530. In a flexible-to-inflexible state transition, layers 510, 520 may, as a result, be brought into more contact with one another and/or more pressurized contact with one another. Alternatively, in an inflexible-to-flexible state transition, layers 510, 520 may be brought into less contact with one another and/or less pressurized contact with one another. After the state transition, valve mechanism 550 may be closed and/or pressure vessel 580 may be coupled to a pump source (not shown) to pressurize or depressurize pressure vessel 580 for a next state transition. Accordingly, embodiments variously provide for highly responsive transitioning of a garment (or other device including a sheet structure) between a flexible state and a relatively inflexible state. Such a garment may be useful in a variety of applications including, but not limited to, healthcare, sport injury prevention, workplace safety, etc.

FIGS. 6A-6H illustrate uses of respective wearable devices, each according to a corresponding embodiment, wherein for each such wearable device, at least some region of the device includes layer portions and an interface region disposed between the layer portions. Such a wearable device may include some or all of the features of garment 102, garment 300 or garment 410, for example. An actuator mechanism of such a wearable device may operate to selectively implement (and/or alleviate) friction jamming. For example, activation of a wearable device of FIGS. 6A-6H may include some or all operations of method 200.

Figure 6B:
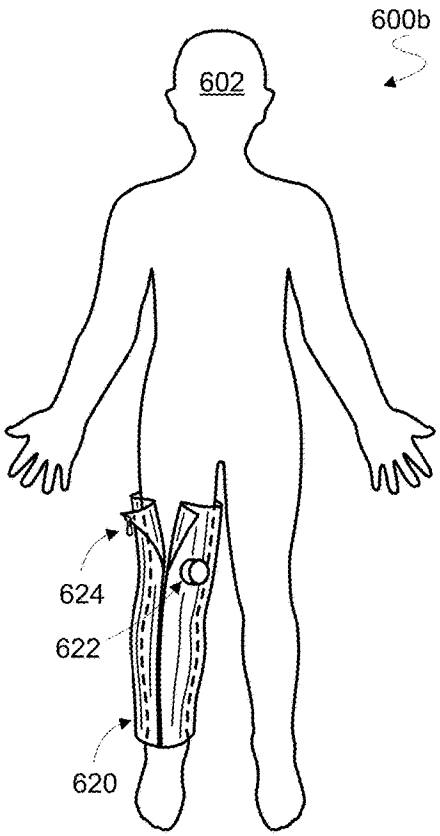
FIGS. 6A-6H illustrate various use cases each for a respective garment according to a corresponding embodiment.
Figure 6A:
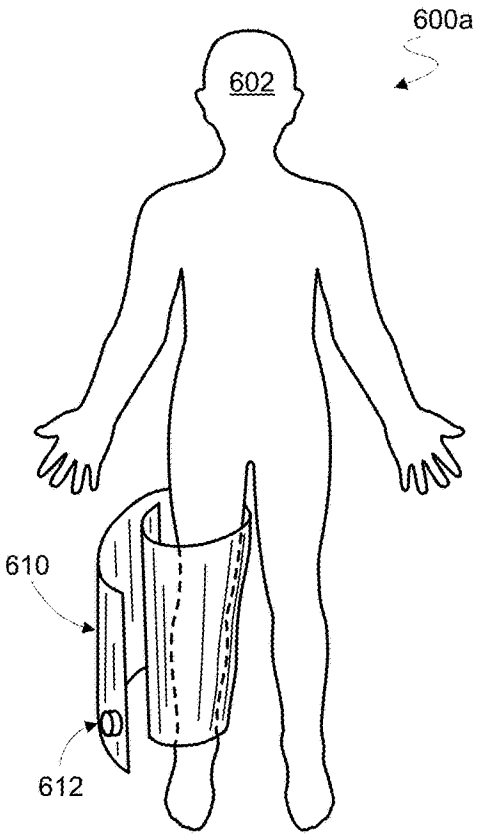

FIG. 6A shows a use case 600*a* wherein a blanket-like device, represented by the illustrative wrap 610, may be placed around a leg (or alternatively, an arm, foot, chest or the like) of a user 602. An interface region (not shown) in wrap 610 may extend across at least some of a sheet-like portion of wrap 610. In the illustrative embodiment shown, wrap 610 includes an actuator 612—e.g., comprising controller logic, a valve mechanism and a chamber—operable to change a flexibility of the blanket-like portion in response to a detector sensing a trigger event. Actuator 612 may transition wrap 610 to or from a friction jamming state in response to a condition detected by sensor logic that, for example, is part of actuator 612 or some other component (not shown) of garment 612. In some embodiments, such a detected condition may be indicated by a wireless communication received by actuator 612.

As shown in FIG. 6B, a use case 600*b* according to an embodiment may include a sleeve 620 capable of being pulled, zipped, buttoned and/or otherwise disposed around a leg or other appendage of user 602 (or some other user). Although certain embodiments are not limited in this regard, sleeve 620 may include securing hardware, such as the illustrative zipper 624 shown, to aid in tightening a fit by sleeve 620 around the leg of user 602. Buttons, clasps, or other securing hardware may be additionally or alternatively provided by sleeve 620, according to different embodiments. Sleeve 620 may include actuator 622 operable to change a flexibility of some or all sheet-like portions of sleeve 620—e.g., where actuator 622 provides some or all functionality of one of actuators 150, 610.

Figure 6D:
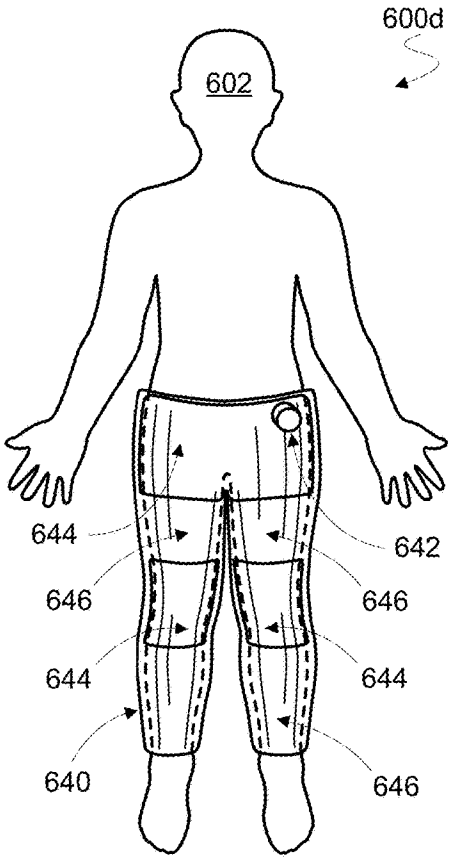
Figure 6C:
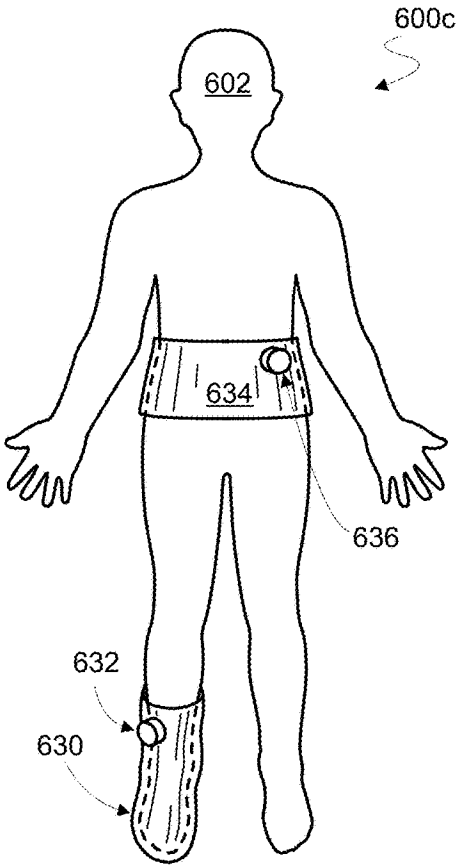

FIG. 6C shows a use case 600*c* wherein a sock 630 is pulled or otherwise disposed around a foot and an ankle of the illustrative user 602. Sock 630 may include an actuator 632 to change a flexibility of an interface region (not shown) that, for example, is included in a portion of sock 630 that is to fit around an ankle of user 602. Actuator 632 may provide some or all functionality of one of actuators 150, 610, for example. Use case 600*c* may additionally or alternatively include a safety belt 634 capable of being clasped, zippered, buttoned or otherwise secured around a mid-section (e.g., including the waist) of the illustrative user 602. Safety belt 634 may include an actuator 636 to change a flexibility of at least some sheet-like portion of safety belt 634. For example, actuator 636 may operate in response to a sensor detecting that user 602 is currently (or will be) lifting and/or carrying some load.

As shown in FIG. 6D, use case 600*d* includes pants garment 640 worn on a lower half of the illustrative user 602. Pants garment 640 may include trousers, leggings or any of various other types of garments to be worn on the legs. Pants garment 640 is one example of a wearable garment, according to various embodiments, including one or more interface regions that are distinguished from one or more regions of the garment where friction jamming cannot be implemented (or may be differently implemented). By way of illustration and not limitation, pants garment 640 may include areas 644, the flexibility of which may be selectively changed by operation of an actuator 642. However, areas 644 may be distinguished, for example, from other areas 646 of pants garment 640 where friction jamming cannot be implemented/alleviated by actuator 642. Location of areas 644 only around various joints—e.g., knees and/or hips—of user 602 may allow for quicker and/or larger changes to the ability of user 602 to move while wearing pants garment 640.

Figure 6F:
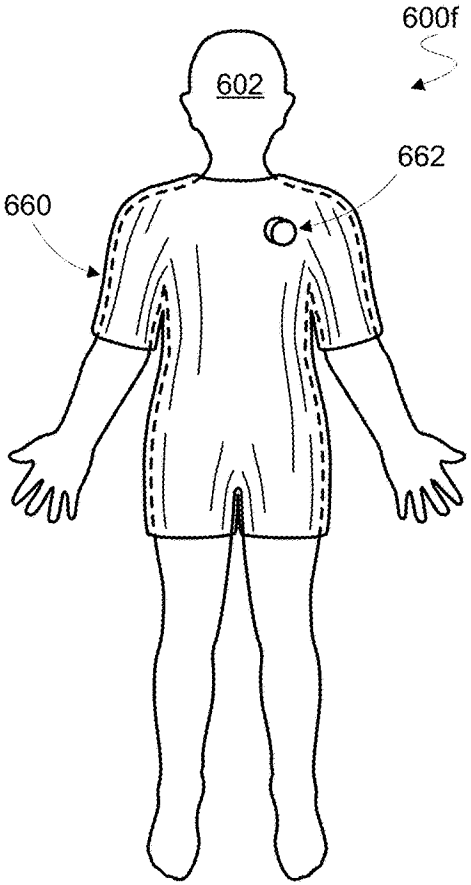
Figure 6E:
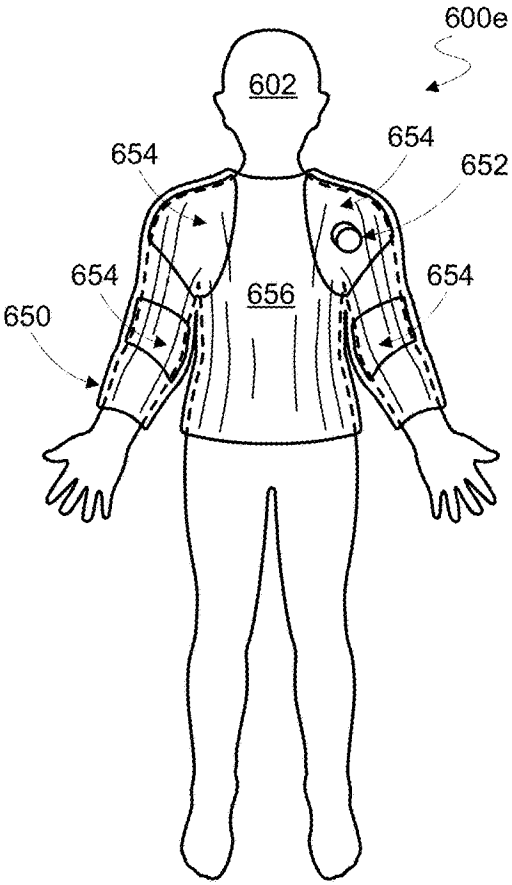

As shown in FIG. 6E, use case 600*e* includes a shirt 650 to be worn on an upper half of the illustrative user 602. Shirt 650 is another example of a wearable garment, only some areas of which may have friction jamming selectively implemented. In the illustrative use case 600*e*, shirt 650 includes areas 654, the flexibility of which may be selectively changed by operation of an actuator 652. Areas 654 are distinguished, for example, from other areas 656 where friction jamming cannot be implemented/alleviated by actuator 652. Location of areas 654 around various joints—e.g., elbows and/or shoulders—of user 602 allows for quick and/or large changes to the ability of user 602 to move while wearing shirt 650.

FIG. 6F shows a use case 600*f* wherein a bodysuit 660 is pulled or otherwise disposed around at least a top part of the illustrative user 602. Bodysuit 660 may include an actuator 632 to change a flexibility of an interface region (not shown) that, for example, extends across some or all of the bodysuit 660. Actuator 632 may provide some or all functionality of one of actuators 150, 610, for example.

Figure 6H:
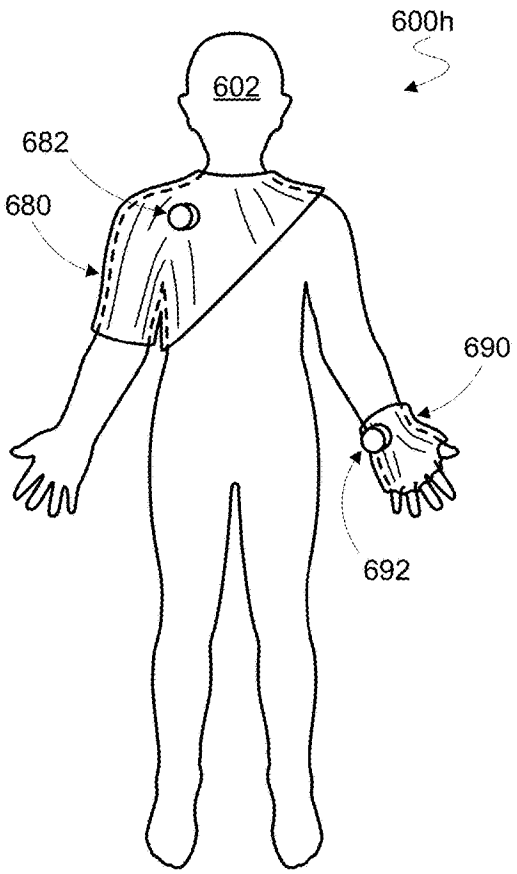
Figure 6G:
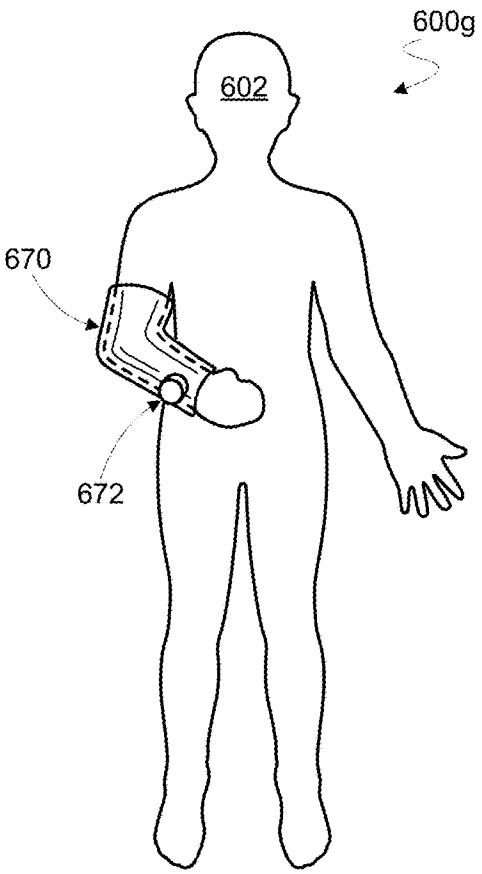

As shown in FIG. 6G, a use case 600*g* according to an embodiment includes a sleeve 670 capable of being pulled and/or otherwise disposed around an arm of user 602 (or some other user). Sleeve 670 may include securing hardware (not shown) to aid in tightening a fit of sleeve 670 on user 602. In an embodiment, sleeve 670 includes an interface region—to surround at least at an elbow of user 602—and an actuator 672 to change a flexibility of sleeve 670 around the interface region.

FIG. 6H shows a use case 600*h* wherein a shoulder cover 680 is pulled or otherwise disposed around a shoulder and upper chest of the illustrative user 602. Shoulder cover 680 may include an actuator 682 to change a flexibility of an interface region (not shown) that, for example, is included in a portion of shoulder cover 680 that is to fit around the shoulder of user 602. Use case 600*h* may additionally or alternatively include a glove 690 to be pulled and/or otherwise disposed around a hand of the illustrative user 602. Glove 690 may include an actuator 692 to change a flexibility of at least some portion of glove 690—e.g., around a wrist of user 602.

Figure 7B:
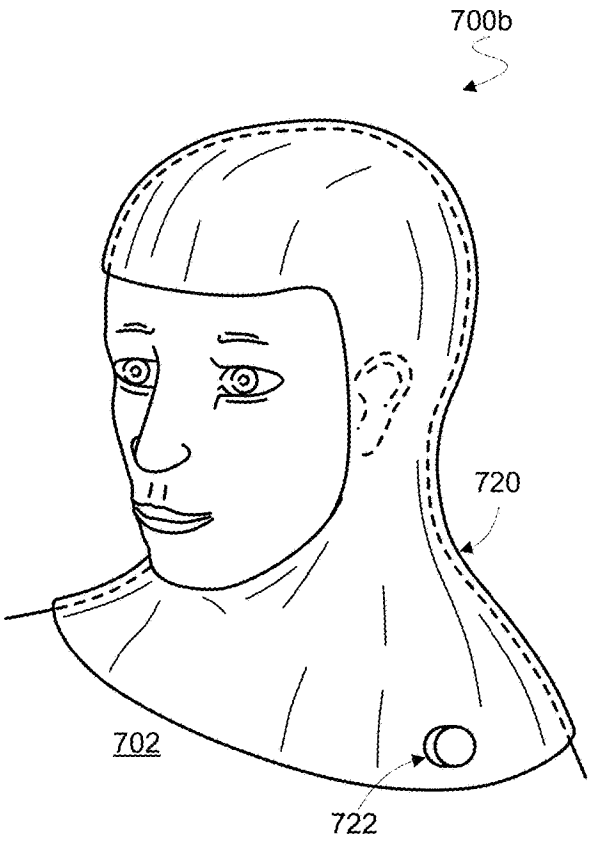
FIGS. 7A, 7B illustrate various use cases each for a respective garment according to a corresponding embodiment.
Figure 7A:
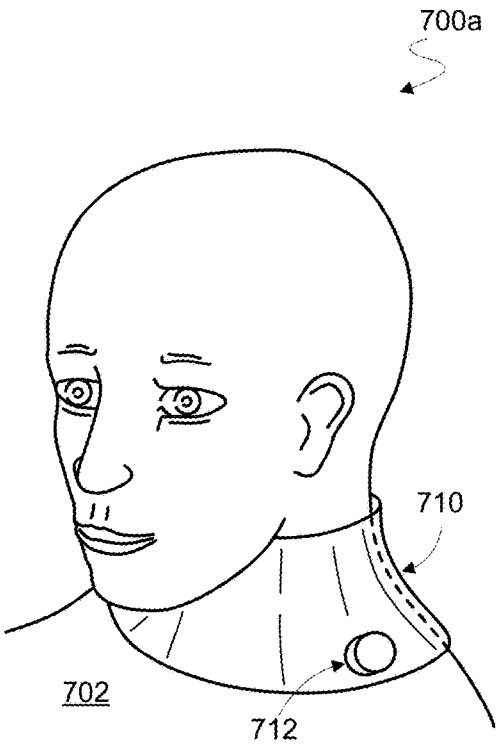

FIGS. 7A-7B illustrate further uses of respective wearable devices, each according to a corresponding embodiment, wherein at least some region of the device includes layer portions and an interface region disposed between the layer portions. As shown in FIG. 7A, a use case 700*a* according to an embodiment includes a neck gaiter 710 that can be pulled, zipped, buttoned and/or otherwise disposed around a neck of a user 702 (or some other user). A zipper, buttons and/or other securing hardware (not shown) may aid in tightening a fit by neck gaiter 710 around the neck of user 702. Neck gaiter 710 may include actuator 712 operable to change a flexibility of some or all sheet-like portions of neck gaiter 710. By way of illustration and not limitation, actuator 712 may induce friction jamming in an area that surrounds the neck of user 702 in response to a sensor—e.g., included in or wirelessly communicating with actuator 712—detecting an automobile accident or other event involving user 702.

FIG. 7B shows another use case 700*b*, according to a different embodiment, wherein a hood 720 is pulled and/or otherwise disposed around the neck and head of the illustrative user 702. Hood 720 may provide head and/or neck protection similar to that provided by neck gaiter 710. An actuator 722 of hood 720 may operate to selectively change a flexibility of some or all sheet-like portions of hood 720. Extension of hood 720 from the neck and around the head of user 702 may provide improved head protection and/or improved leverage to resist whiplash injury to the neck of user 702.

What is claimed is:

1. A device comprising:

a first sheet structure including:

a first layer portion; and a second layer portion overlapping the first layer portion, wherein an interface region is disposed between the first layer portion and the second layer portion;

a chamber to store a fluid;

a valve coupled between the chamber and the interface region; and control logic coupled to generate a signal while a pressure differential between the chamber and the interface region is maintained by the valve, wherein in response to the signal, the valve transitions to an open state to allow an exchange of the fluid between the chamber and the interface region, wherein the exchange results in a change to a flexibility of the first sheet structure, wherein, prior to the open state or during the open state, the first layer portion and the second layer portion are pressurized against one another.

2. The device of claim 1, wherein the device comprises a garment.

3. The device of claim 2, wherein a joint portion of the garment is positioned on the garment wrap around a joint of a user when the garment is worn by the user, wherein the joint portion includes the interface region.

4. The device of claim 1, further comprising a sensor to detect an activation condition and to generate an indication of the activation condition, wherein the control logic to generate the signal in response to the indication of the activation condition.

5. The device of claim 4, wherein the activation condition includes a characteristic of a force imposed on the device.

6. The device of claim 4, wherein the activation condition includes a biometric condition of a wearer of the device.

7. The device of claim 4, wherein the activation condition includes an explicit command by a user to change a flexibility of the first sheet structure.

8. The device of claim 1, further comprising communication logic to receive a wireless communication including an indication of an activation condition, wherein the control logic to generate the signal in response to the indication of the activation condition.

9. The device of claim 1, further comprising a second sheet structure, wherein an actuator of the device includes the valve and the control logic, and wherein, of the first sheet structure and the second sheet structure, the actuator is configured to change a flexibility of only the first sheet structure.

10. The device of claim 1, further comprising a pump coupled to the chamber, the pump to generate the pressure differential between the chamber and the interface region.

11. The device of claim 1, further comprising a connector to couple the device to a pump, wherein the pump generates the pressure differential between the chamber and the interface region.

12. A method of operation of a device including a first sheet structure, the method comprising:

receiving a control signal during a pressure differential between and an interface region and a chamber of the device, the interface region positioned between overlapping layer portions of the first sheet structure;

in response to the control signal, transitioning a valve coupled between the chamber and the interface region to an open state; and exchanging a fluid between the interface region and the chamber via the valve during the open state, wherein the exchanging results in a change to a flexibility of the first sheet structure, and wherein, prior to the open state or during the open state, the overlapping layer portions of the first sheet structure are pressurized against one another.

13. The method of claim 12, wherein the device comprises a garment.

14. The method of claim 12, further comprising:

detecting an activation condition with a sensor of the device; and generating the control signal based on the detecting of the activation condition.

15. The method of claim 14, wherein the activation condition includes an environmental condition external to the device.

16. The method of claim 12, further comprising:

receiving a wireless communication including an indication of an activation condition; and generating the control signal in response to the indication of the activation condition.

17. The method of claim 12, wherein, of the first sheet structure and a second sheet structure of the device, a flexibility of only the first sheet structure is changed.

18. A system comprising:

a garment including:

a first sheet structure including a first layer portion and a second layer portion overlapping the first layer portion, wherein an interface region is disposed between the first layer portion and the second layer portion;

a chamber to store a fluid;

a valve coupled between the chamber and the interface region; and control logic coupled to generate a signal while a pressure differential between the chamber and the interface region is maintained by the valve, wherein in response to the signal, the valve transitions to an open state to allow an exchange of the fluid between the chamber and the interface region, wherein the exchange results in a change to a flexibility of the first sheet structure, and wherein, prior to the open state or during the open state, the first layer portion and the second layer portion are pressurized against one another; and a detector including:

a first sensor to detect an activation condition; and input/output (I/O) logic coupled to the first sensor, the I/O logic comprising circuitry configured to send to the garment a wireless communication including an indication of the activation condition, wherein the control logic is configured to generate the signal in response to the indication of the activation condition.

19. The system of claim 18, wherein the activation condition includes an environmental condition external to the device.

20. The system of claim 18, the garment further comprising a second sheet structure, wherein an actuator of the garment includes the valve and the control logic, and wherein, of the first sheet structure and the second sheet structure, the actuator is configured to change a flexibility of only the first sheet structure.

* * * * *